US005307788A

United States Patent [19]

Peck

[11] Patent Number: 5,307,788

[45] Date of Patent: May 3, 1994

[54] TWIN JAW BOW STRING RELEASE

[75] Inventor: Paul L. Peck, Fond du Lac, Wis.

[73] Assignee: Tru-Fire Corporation, Fond du Lac, Wis.

[21] Appl. No.: 758,779

[22] Filed: Sep. 12, 1991

[51] Int. Cl.[5] ..... F41B 5/00

[52] U.S. Cl. ..... 124/35.2

[58] Field of Search ..... 124/31, 35.1, 35.2

[56] References Cited

U.S. PATENT DOCUMENTS

| | | | |
|---|---|---|---|
| 2,488,597 | 11/1949 | Konold | 124/35.2 |
| 2,819,707 | 1/1958 | Kayfes et al. | 124/35.2 |
| 3,898,974 | 8/1974 | Keck | 124/35.2 |
| 3,954,095 | 5/1976 | Lewis | 124/35.2 |
| 4,066,060 | 1/1978 | Napier | 124/35.2 |
| 4,257,386 | 3/1981 | Gazzara | 124/35.2 |
| 4,308,851 | 1/1982 | Kaine, Jr. et al. | 124/35.2 |
| 4,392,475 | 7/1983 | Fletcher | 124/35.2 |
| 4,403,594 | 9/1983 | Todd | 124/35.2 |
| 4,485,798 | 12/1984 | Hamm | 124/35.2 |
| 4,489,705 | 12/1984 | Larson | 124/35.2 |
| 4,527,536 | 7/1985 | Smith | 124/35.2 |
| 4,567,875 | 2/1986 | Fletcher | 124/35.2 |
| 4,620,523 | 11/1986 | Peck | 124/35.2 |
| 4,674,469 | 6/1987 | Peck | 124/35.2 |
| 4,691,683 | 9/1987 | Peck | 124/35.2 |
| 4,854,293 | 8/1989 | Roberts | 124/35.2 |
| 4,881,516 | 11/1989 | Peck | 124/35.2 |
| 4,926,835 | 5/1990 | Peck | 124/35.2 |
| 5,027,786 | 7/1991 | Peck | 124/35.2 |

*Primary Examiner*—Randolph A. Reese
*Assistant Examiner*—Christopher J. Novosad
*Attorney, Agent, or Firm*—Robert C. Curfiss

[57] ABSTRACT

A bow string release with a head carrying at least one sear movable between a closed string retaining position and an open string releasing position, and a latch pin axially movable for selectively directly engaging and locking the sear in the string retaining position.

9 Claims, 4 Drawing Sheets

FIG. 1
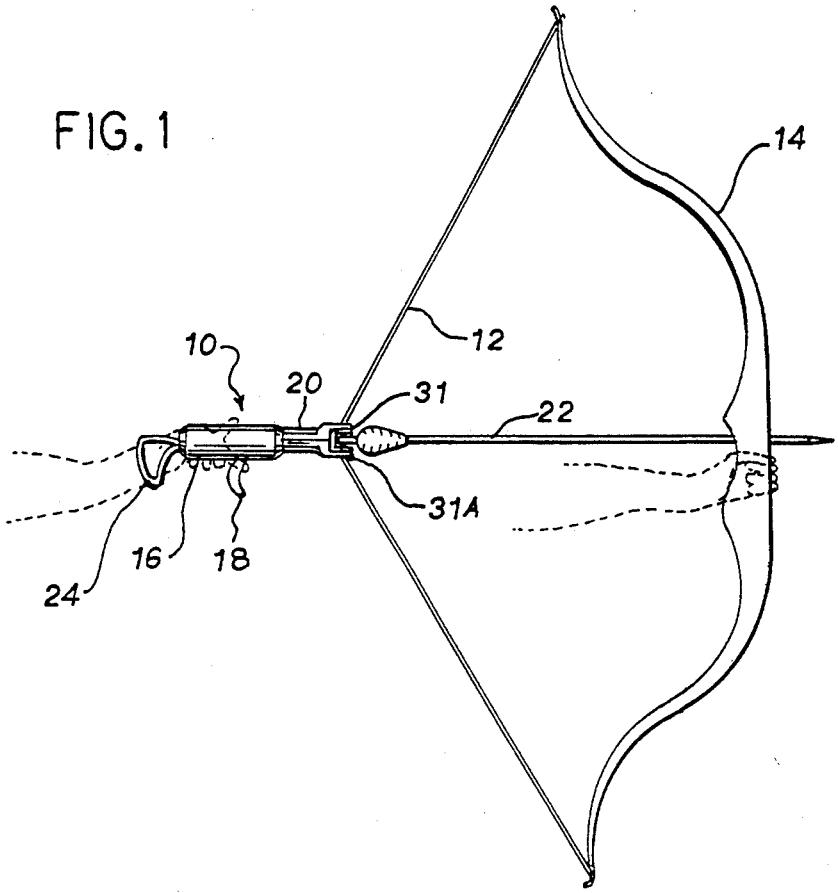
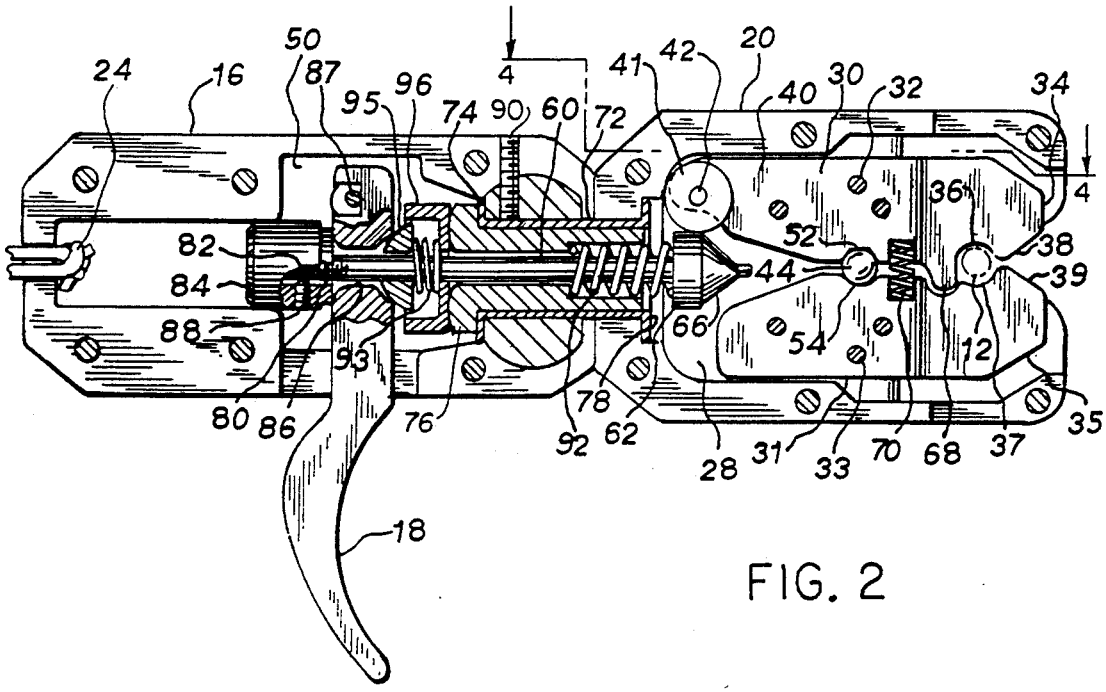
FIG. 2

FIG. 3
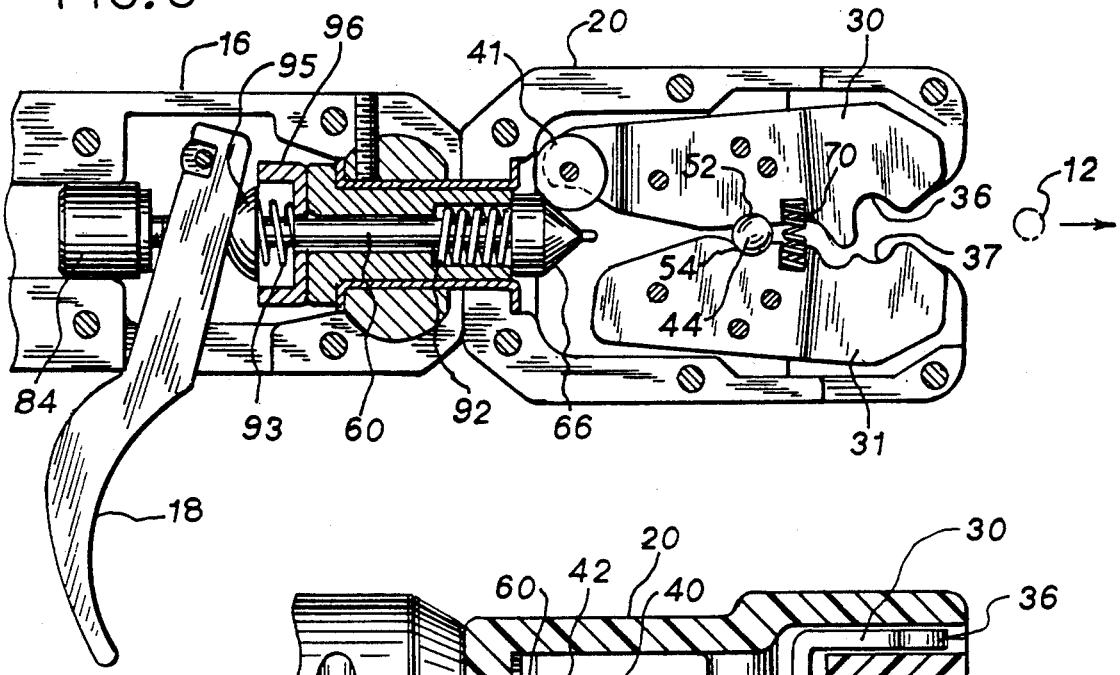
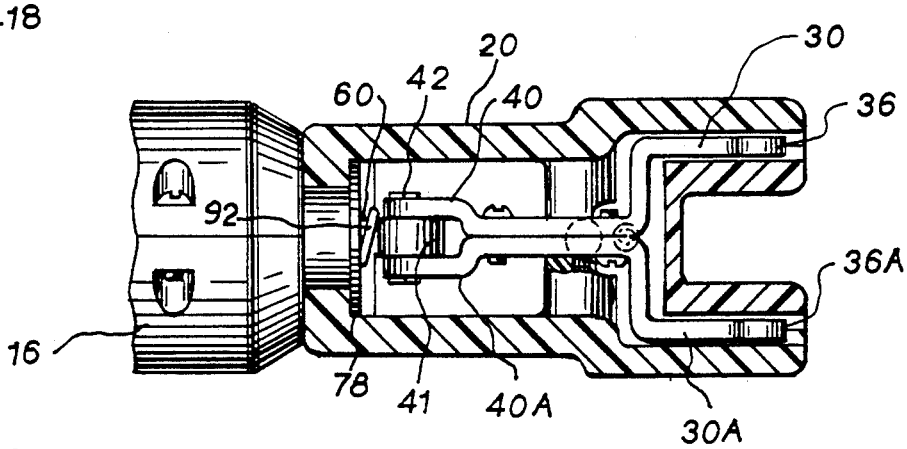
FIG. 4
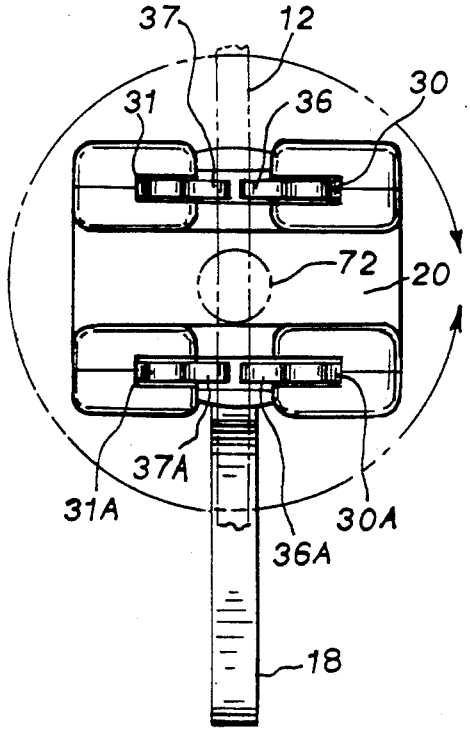
FIG. 5

FIG. 6
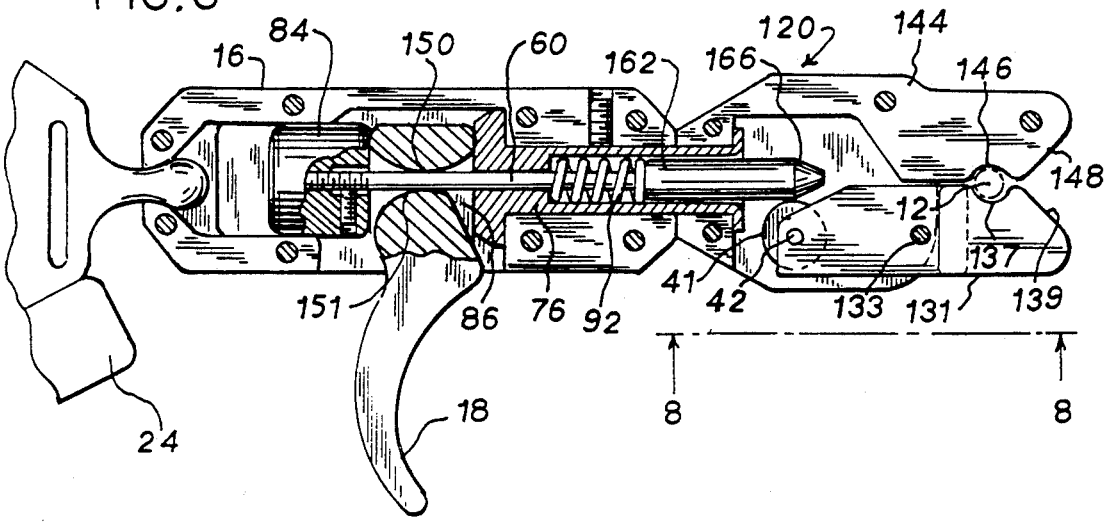
FIG. 7
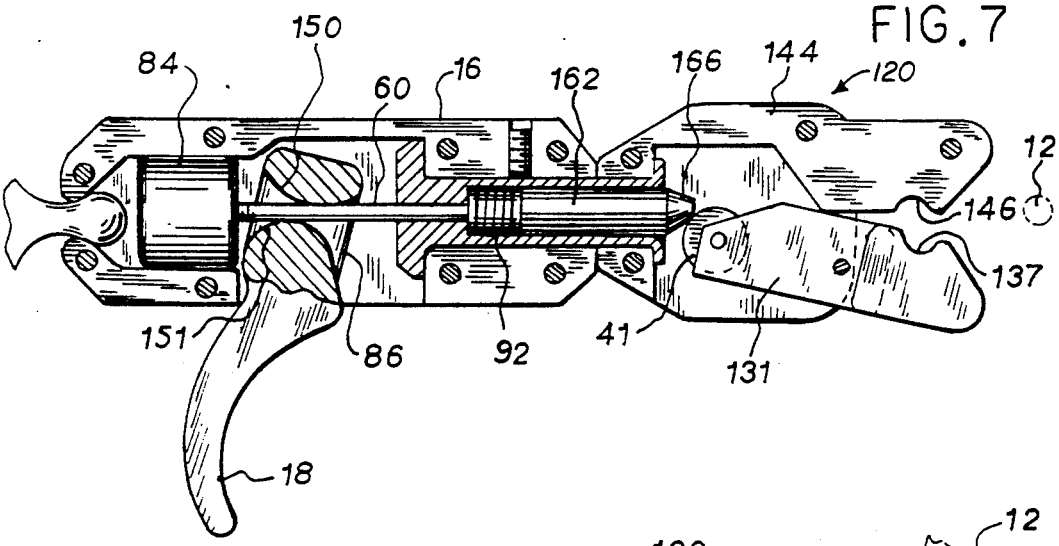
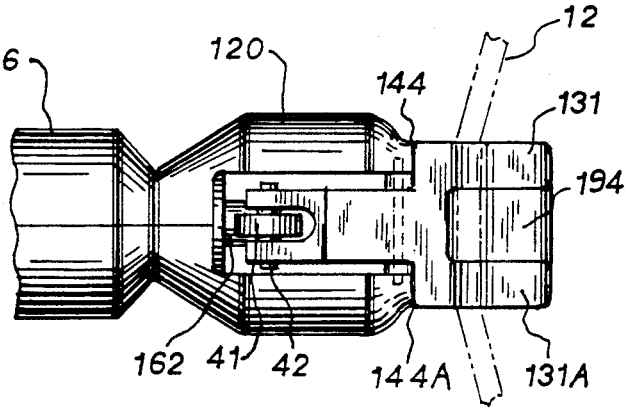
FIG. 8

TWIN JAW BOW STRING RELEASE

BACKGROUND OF THE INVENTION

1. Field of the Invention

This invention relates generally to bow string releases of the type having a releasable sear for retaining a bow string, and more particularly to a bow string release having a balanced release above and below the arrow nock.

2. Description of the Prior Art

This invention is related to my co-pending application Ser. No. 07/758,778 entitled: "Rotationally Adjustable Bow String Release", filed on even date herewith.

In recent years, bow string releases have grown in popularity for both target shooting and hunting. A good release provides uniform control of the bow string and increases accuracy. The release is either hand-held or strapped to the wrist and has a trigger which permits the archer to release the string. Typically, such devices employ a releasable sear that engages the bow string, the sear being movable from a string retaining position to a release position for releasing the string. Releases of this type are illustrated in U.S. Pat. Nos. 4,485,798; 4,066,060; 3,954,095; and 3,898,974. It is also known to use ball type elements in place of the sear to retain and release the string, wherein the ball elements are held by a head and retained in position by a yoke or sleeve. A device of this type is illustrated in U.S. Pat. No. 4,403,594.

In typical use, the releases are used to maintain the bow string in a cocked position in which the bow string is flexed against the tension of the bow for propelling an arrow supported on the bow string. The arrow includes a notched nock which is configured to receive the bow string to insure stability of the arrow during cocking and release of the bow string. The nock of the arrow is preferably disposed at or near the mid-point of the bow string to insure that the flight of the arrow is as true as possible.

In most applications, the release is designed to support the nock of the arrow at or near the mid-point of the bow string when cocked. With the lighter weight arrows now popular, the slight angle of the bow string caused by cocking the string with a release of the prior art may be sufficient to cause axial wobble or tilting on release of the arrow. Accordingly, there is a need for a bow release which will hold the bow string in a position substantially perpendicular to the axis of the arrow when cocked to assure true flight of the arrow.

SUMMARY OF THE INVENTION

The subject invention provides a bow string release with a head carrying a pivotable sear movable between a closed string retaining position and an open string releasing position, and a latch for selectively engaging and locking the sear in the string retaining position. The release mechanism of the subject invention may include a single movable sear element adapted for movement between an open and closed position against an abutment on the head of the release, or in the alternative, may include complementary, coacting sear elements which are designed to simultaneously pivot and release the string from the string retaining notch.

In the preferred embodiment, the sear includes a roller mounted on one end and the latch includes a tapered pin for engaging the roller when the pin is extended to lock the sear in the closed position. The roller rides on the tapered pin as it is retracted, permitting pivotable movement of the sear to the open position for releasing the bow string.

In one embodiment of the invention, the sear includes a pair of spaced string retaining notches, adapted for engaging the bow string above and below the nock of an arrow, whereby the bow string is maintained substantially perpendicular to the axis of the arrow when the string is placed in the release mechanism.

In the preferred embodiment of the invention, the trigger mechanism is carried in a body separate from the head, the body being rotatable relative to the head to permit selective angular orientation between the string retaining notch and the trigger.

It is, therefore, an object of the present invention to provide an improved bow string release mechanism for providing smooth movement of the string retaining sear from a closed string retaining position to an open string releasing position in response to a movement of the release trigger.

It is a further object of the invention to provide a string release mechanism including means for retaining the bow string above and below the nock of an arrow for maintaining the string in a position substantially perpendicular to the arrow when the string is held by the release.

It is yet another object of the invention to provide a bow string release having a sear carrying head mounted for rotation relative to a trigger carrying body to provide for selective angular orientation between the string retaining sear and the trigger mechanism.

Other objects and features of the invention will be readily apparent from the accompanying drawing and description.

BRIEF DESCRIPTION OF THE DRAWING

FIG. 1 is an illustration of a bow string release in accordance with the subject invention and shown as used with a typical bow and arrow.

FIG. 2 is an enlarged plan view of a release mechanism as shown in FIG. 1, shown in the closed, string retaining position with covers removed and with the head rotated 90° from the orientation shown in FIG. 1.

FIG. 3 is a view similar to FIG. 2, showing the release in the open, string releasing position.

FIG. 4 is a section view taken along line 4—4 of FIG. 2.

FIG. 5 is a front plan view of the release shown in FIGS. 2–4.

FIG. 6 is a plan view of an alternative embodiment of the bow string release of the present invention shown in the closed, string retaining position, with covers removed and with the head and body in the same orientation as shown in FIG. 2.

FIG. 7 is a view similar to FIG. 6, showing the release in the open position.

FIG. 8 is a fragmentary view taken along line 8—8 of FIG. 6.

DETAILED DESCRIPTION OF THE PREFERRED EMBODIMENT

Figure 9:
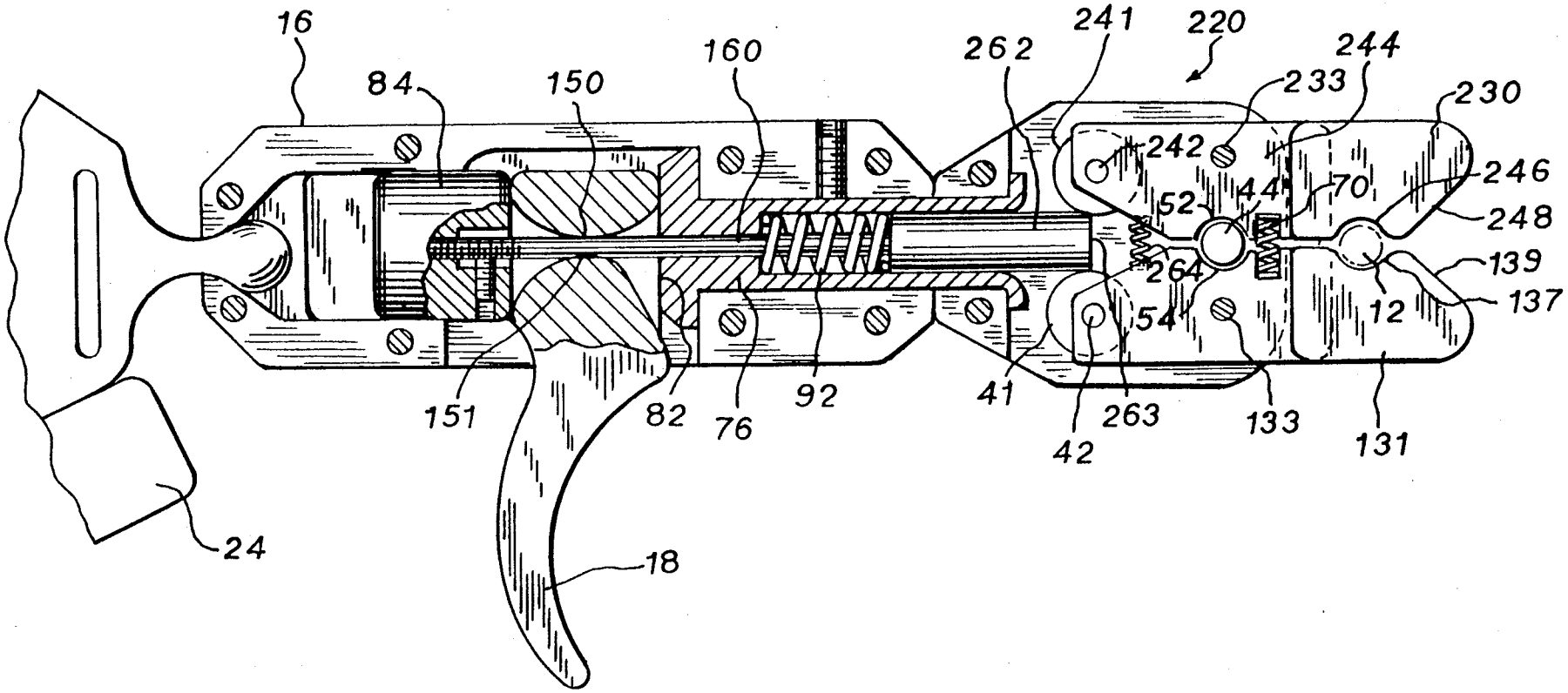
FIG. 9 is a plan view similar to FIG. 6, showing an alternative embodiment of the bow string release of the present invention with a dual roller configuration.

As shown in FIG. 1, the bow string release 10 of the subject invention is adapted to retain the bow string 12 of a typical bow 14 for holding and pulling the bow string as shown. In the preferred embodiment, the release includes a body 16 having a trigger 18 and a head 20, mounted on the body and including a string retaining notch and release mechanism as shown in FIGS. 2–7. An arrow 22 includes a nock 24 which is engaged by the bow string 12. In the preferred embodiment, the release 10 includes a pair of string retaining sear elements at 31, 31A spaced above and below the nock 24 of the arrow to maintain the string 12 substantially perpendicular to the axis of the arrow when the string is engaged and retained by the release. The body 16 may be of any desired configuration such as, by way of example, the palm grip shown in the drawings and/or a pistol grip or other known designs. Typically, a wrist strap 24 is included for securing the release 10 to the wrist of the user.

An enlarged plan view of the release is shown in FIG. 2, with the head 20 rotated 90° from the orientation shown in FIG. 1, and with the covers removed to expose the working mechanism. As there shown, the head 20 may be made of unitary molded construction including a cavity 28 adapted to receive and carry a pair of elongate sear elements 30, 31 each pivotable about a pivot post 32, 33, respectively, provided in the cavity 28. The outer ends 34, 35 of the sear elements include notches 36, 37 adapted for receiving the bow string. In the preferred embodiment, the outer ends 34, 35 of the sear elements 30, 31 are tapered or beveled as shown at 38, 39 to facilitate reception of the bow string 12 as it is entered into the notches 36, 37. In the preferred embodiment of the invention, the inner end 40 of the sear 30 includes a roller 41 mounted for rotation on the axis pin 42. A floating bearing 44 is carried in a socket defined by the complementary recesses 52 and 54 in the sear elements 30 and 31. The center of the bearing 44 is in alignment with the axes of the pivot posts 32 and 33 and acts to lock sear 31 in the closed position shown when the latch pin 60 is extended and the roller 41 is in engagement with the enlarged peripheral surface 62 of the latch pin.

When the latch pin is retracted by movement of the trigger 18, the roller 41 rides up the tapered tip 66 of the latch pin, permitting the sear 30 to pivot from the closed position shown to the open position to release the bow string. It will be understood by those who are skilled in the art that the roller, while preferred to ensure smooth operation, could be eliminated without altering the function between the latch pin 66 and the sear 30. As the sear 30 pivots open, the bearing 44 rides to the right as shown in FIG. 3, with socket recess 52, simultaneously pushing the bearing in the socket recess 54 of sear 31 to pivot the sear 31 outward and open. In this manner, the sears 30 and 31 move in unison about the respective pivots 32 and 33 between the opened and closed positions.

In the preferred embodiment, a tab 68 is provided on sear 30 behind and adjacent the notches 36 and 37. When a bow string is introduced into the notch, it engages the tab 68. By applying a force to the bow string, and thereby to the tab 68, the sears 30 and 31 are urged to the left as shown and pivot from the opened to the closed position, allowing the latch pin 60 to advance for locking the sears in the closed, string retaining position. A compression spring 70 is mounted in the head with opposite ends engaging the sears 30 and 31 for continuously urging the sears into the opened, string releasing position whenever the latch pin 60 is retracted as shown in FIG. 2.

The body 16 of the release may also be of unitary molded construction and includes a cavity 50 for carrying the latch mechanism and the trigger 18. In the preferred embodiment, the body 16 and head 20 are mounted on a hollow cylindrical shaft or spool 72 and integral sleeve 74. The spool and/or sleeve include enlarged ends 76 and 78 which are received by complementary cavities in the body and head, respectively. When the covers (not shown) are secured to the body and head, the body, spool and head are maintained in assembled relationship. An elongate latch pin 60 extends through the central aperture of the hollow spool and has one end 62 extending into the head for engaging the sear and the other end 80 extending into the body for engaging the trigger 18. End 62 of the latch pin terminates in a tapered conical tip 66 which is adapted for engaging the roller 41 on the sear 30. When the latch pin 60 is in its fully extended position as shown in FIG. 2, the full circumference of the enlarged portion 62 of the pin engages the roller 41 to maintain the sears 30, 31 in closed, string retaining position. When the pin is retracted into the body, the roller rides on the tapered tip 66, permitting the sear to pivot about the pivot pin post 32 and move from the closed to the open position to release the bow string, simultaneously opening sear 31, as described. The roller 41 provides a smooth opening action as the latch pin is retracted into the body.

The opposite end 80 of the latch pin 60 terminates in a threaded portion 82 which is adapted for receiving an adjusting knob 84. The trigger 18 includes a through aperture 86 for receiving the latch pin 60. The adjusting knob 84 is threadably received by the threaded end portion 82 of the latch pin for adjusting the travel required of the trigger 18 to move the latch pin from the full extended position shown to the fully retracted position to permit opening of the sears 30, 31.

A set screw 88 may be provided in the adjusting knob 84 for locking the knob in position once the trigger is properly adjusted. In addition, a set screw 90 may be provided in the body 16 for engaging the perimeter of the spool sleeve 74 to lock the rotational orientation between the head 16 and the body 20. In the preferred embodiment, tension spring 92 is provided in the spool 76 and engages the enlarged end 62 of the latch pin 60 to continuously urge the latch pin into the extended position for maintaining the sears 30, 31 in the closed, string retaining position. A second compression spring 93 is carried in the body and has one end in engagement with a retaining clip 95 which is carried by the latch pin 60. The other end of the spring 93 is in engagement with an abutment 96 provided in the body between the trigger 18 and the spool 76. The spring 93 provides biasing for urging the trigger 18 into engagement with the adjusting knob 84.

In the preferred embodiment, the trigger 18 is mounted in the body 16 for pivotable movement on the integral post 87.

As shown in FIGS. 4 and 5, the sears each include an upper section 30, 31 and a lower section 30A, 31A. The respective notches are also included in both sections as shown at 36, 36A and 37, 37A, respectively, wherein the bow string 12 is engaged above and below the nock 24 of the arrow 22 when the release is in the closed, string retaining position. The space 94 between the upper sears 30, 31 and the lower sears 30A, 31A is adequate to receive the nock of a typical arrow. The spaced sear notches 36, 37 and 36A, 37A maintain the bow string 12 substantially perpendicular to the axis of arrow when the string is retained by the release mechanism.

An alternative embodiment of the subject invention is shown in FIGS. 6-8. The body 16, trigger 18, latch pin 60 and spool 76 are identical in function to the embodiment of FIGS. 1-5.

The head 120 is modified to include a single sear element 131 pivotable about the single pivot post 133. The roller 41 and roller axis pin 42 are identical to and function the same as the roller 41 and pin 42 illustrated in FIGS. 2-4. The outer end of the sear element 131 includes a notch 137 for receiving the bow string. The head 120 includes an extension 144 having a notched portion 146 complementary with the notch 137 on the sear 131. In the preferred embodiment, the head extension 144 includes a beveled or tapered end portion 148. The outer end of the sear 131 is also tapered or beveled at 139. The beveled ends facilitate reception of the bow string when it is introduced into the sear notches. When the sear 131 is in the closed position, as shown, the notch 146 and notch 137 close to conform substantially to the perimeter of the bow string and maintain the bow string in the release.

The sear and head extension may include a pair of spaced apart, complementary notch defining portions 131, 131A and 144, 144A, respectively, as shown in FIG. 8, wherein the arrow nock is placed in the space between the spaced notch portions, whereby the bow string 12 is maintained substantially perpendicular to the axis of the arrow in the space 194 when the string is retained.

As particularly shown in FIGS. 6 and 7, the latch pin 60 may be slightly modified from that shown in FIGS. 1-4, wherein the enlarged end 162 extends into the spool 76 to retain the compression spring 92 completely within the spool in both the closed (FIG. 6) and open (FIG. 7) positions. While shown as having a tapered end, it will be readily understood that the shape of the operating tip of the latch pin is a matter of choice, depending on the desired feel of the trigger action. The tapered end portion 166 operates as in FIGS. 1-4, whereby as the trigger 18 is pulled against the adjusting knob 84, the roller 41 rides up on the tapered tip 166 to permit the sear element 131 to open for releasing the string 12, as shown in FIG. 7. As is readily apparent from FIGS. 6 and 7, this embodiment includes only one movable sear element, the extension 144 of the head 120 and its respective notch 146 being maintained in a stationary position relative to the head 120 at all times.

It will also be noted that the trigger 18 includes a pair of opposed radial surfaces 150 and 151 at the through aperture 86, permitting the trigger to be carried solely by the pin 60 rather than being mounted on the pivot post 87 as provided in the embodiments of FIGS. 1-5. The other minor modifications to the sleeve and body of the embodiment of FIGS. 6-8 are not important to the understanding and function of the invention.

It will, of course, be understood that the relationship between the pin 60 and the sear 30 (FIGS. 1-5) or sear 131 (FIGS. 6-8) control the movement of the mechanism between the closed position (FIGS. 2 and 6) and the open position (FIGS. 3 and 7). The preferred configurations shown, using the tapered pin head in combination with a roller could be replaced with any shape pin and any receiving surface which permits relative sliding motion between the two components. The action of the latch and sear is an important feature of the invention independently of the structure.

An alternative embodiment of the subject invention is shown in FIG. 9. The body 16, trigger 18 and spool 76 are identical in function to the embodiment of FIGS. 1-5 and to the embodiments of FIGS. 6-8. It will be noted that the latch pin 160 includes an enlarged portion 262 having a flat or blunt end 263. The head 220 is modified to include a pair of sear elements 131 and 230. The sear elements 131 and 230 are mounted on the respective pivot post 133 and 233 in the head 220 to pivot between the closed position shown in FIG. 9 and the open position, similar to that shown in FIG. 3.

In the embodiment of FIG. 9, the sear element 131 includes a string retaining notch 137 which is complementary to and mated with the string retaining notch 246 of the sear element 230. As in the embodiment of FIGS. 1-5, a floating bearing 44 is carried in a socket defined by the complementary recesses 52 and 54 in the respective sear elements 230 and 131. The center of the bearing 44 is in alignment with the axes of the pivot post 133 and 233 and acts to lock the sear elements 131 and 230 in the closed position when the latch pin 262 is extended, as shown. As in the embodiment of FIGS. 1-5, the inner end of sear 131 includes a roller 41 mounted for rotation on the axis pin 42. It will be noted that the sear 230 also includes a roller 241 mounted for rotation on the axis pin 242. The flat end 263 of the pin 262 is adapted to engage both rollers 241 and 41 for holding the sear mechanism in the closed position of FIG. 9 when extended as shown. When the trigger is actuated to overcome the force of spring 92, the pin 262 is retracted into the body 16 or toward the body 16, whereby the flat end 263 of the pin is removed from engagement with the rollers 241 and 41, permitting the sears to pivot outwardly about the pivot points 133 and 233 for withdrawing the notches 137 and 246 to release the string 12, in a manner similar to that shown in FIG. 3.

A compression spring 70 may be positioned in advance of the floating bearing 52 for urging the sears 131 and 230 into the open position when not engaged by the pin 262, facilitating re-entry of the string 12 into the open notches. A second spring 264 may be used to also urge the sears 230 and 131 into the open position. It will be readily understood by those who are skilled in the art that the springs 70 and 264 may be used independently of one another or in combination, depending on the feel required by the user and required to meet the intended operating characteristics of the release.

While certain embodiments and features of the invention have been described herein, it will be understood that the invention includes all alternative embodiments and modifications within the scope and spirit of the following claims.

What is claimed is:

1. A bow string release of the type having a head including a sear mechanism adapted for receiving and holding a bow string adjacent the nock of an arrow and selectively movable between a closed, string retaining position and an open, string releasing position, a body attached to the head and including a trigger and latch mechanism for communicating the trigger with the sear mechanism and responsive to movement of the trigger to release the sear mechanism from the closed position to the open position, the improvement comprising:

a. a pair of elongate sears movably mounted in the head and each having an inner end and an outer end, the outer end including a string receptive notch for engaging and retaining a bow string;

b. an elongate latch pin axially movable between an extended position and a retracted position in response to movement of the trigger, the pin adapted for engaging said inner end of one of said sears when the pin is in the extended position, for locking the sear in a string retaining position, whereby the movement of the latch pin from the extended position to the retracted position permits the inner end of the sear to ride on the pin for pivoting the said one sear from the closed, string retaining position to the open, string releasing position; and c. a floating bearing between and in abutting engagement with both of said elongate sears and in substantial alignment with the pivot points thereof, whereby the other of said sears is maintained in the closed, string retaining position when said one sear is locked in the closed, string retaining position by said latch pin, and said other elongate sear is pivoted to the open, string releasing position when said latch pin is retracted.

2. The release of claim 1, further including a roller mounted for rotation on the inner end of said one sear, the axis of rotation being substantially parallel to the string when retained in said notch and wherein the pin axis is substantially perpendicular to the axis of rotation of the roller.

3. The release of claim 1, wherein said pin includes a tapered end adapted for engaging said inner end of the one sear.

4. The release of claim 1, the one elongate sear including a pair of spaced, string retaining notches, one adapted for engaging and retaining the bow string above the arrow nock and the other adapted for engaging and retaining the bow string below the arrow nock, whereby the bow string is maintained substantially perpendicular to the axis of the arrow when the release is in the string retaining position.

5. The release of claim 1, wherein each of said elongate sears includes a pair of complementary spaced, string retaining notches, the first set of said string retaining notches adapted for engaging and retaining the bow string above the arrow nock and the other of said set of complementary notches adapted for engaging and retaining the bow string below the arrow nock, whereby the bow string is maintained substantially perpendicular to the arrow axis when the release is in the string retaining position.

6. The release of claim 1, further including:

a. a hollow cylindrical spool having opposite ends;

b. said body mounted on one end of said spool for carrying the trigger;

c. the head mounted on the other end of said spool, said body and head selectively rotatable relative to one another;

d. said latch pin carried in said hollow spool and having one end extending into said head for engaging said one sear and another end extending into said body for engaging said trigger.

7. The release of claim 1, including biasing means in engagement with said sears for continuously urging the sears into the open, string releasing position when said latch pin is retracted.

8. The release of claim 1, including biasing means in engagement with said latch pin for continuously urging said pin into the extended position.

9. The release of claim 1, including a tab on said one sear and adjacent said notch for intercepting a bow string when said bow string is introduced into the notch, whereby application of a force on said bow string and against said tab urges the sear into the closed, string retaining position.

* * * * *